US005322257A

United States Patent [19]

Verderose et al.

[11] Patent Number: 5,322,257

[45] Date of Patent: Jun. 21, 1994

[54] FURNITURE CORNER

[76] Inventors: Guy R. Verderose, 156-36 94 St.; Anthony M. Postilio, 156-30 95th St., both of Queens, N.Y. 11414

[21] Appl. No.: 864,562

[22] Filed: Apr. 7, 1992

[51] Int. Cl.[5] ..... A47B 95/00

[52] U.S. Cl. ..... 248/345.1; 248/205.3

[58] Field of Search ..... 248/345.1, 205.3; 52/254; 229/DIG. 1; 206/512, 586

[56] References Cited

U.S. PATENT DOCUMENTS

| | | | |
|---|---|---|---|
| 3,041,775 | 7/1962 | Brown | 248/345.1 |
| 3,410,474 | 11/1968 | Keil | 248/345.1 X |
| 3,725,188 | 4/1973 | Kalt | 248/345.1 X |
| 3,866,873 | 2/1975 | Bohli | 248/205.3 X |
| 3,922,408 | 11/1975 | Smith | 248/345.1 X |
| 4,012,878 | 3/1977 | Ellington | 52/254 |
| 4,072,231 | 2/1978 | Helms | 206/586 X |
| 4,742,916 | 5/1988 | Galea | 229/DIG. 1 X |
| 4,817,902 | 4/1989 | Mason | 248/345.1 |
| 5,065,972 | 11/1991 | Buckshaw | 206/586 X |

FOREIGN PATENT DOCUMENTS

| | | | |
|---|---|---|---|
| 1197958 | 12/1985 | Canada | 248/345.1 |

*Primary Examiner*—J. Franklin Foss
*Attorney, Agent, or Firm*—Leon Gilden

[57] ABSTRACT

A cushioned corner cover member is arranged for mounting to a lower distal end of furniture corners to afford protection to individuals inadvertently impacting to the corner portions of such furniture structure. The corner cover members are each formed with a first and second cushioned wall orthogonally oriented relative to one another having a flexible web spanning a bottom wall of each corner wall to accommodate a furniture leg thereon.

1 Claim, 5 Drawing Sheets

FURNITURE CORNER

BACKGROUND OF THE INVENTION

1. Field of the Invention

The field of invention relates to corner cover structure, and more particularly pertains to a new and improved furniture corner cover wherein the same is arranged for ease of mounting to a furniture corner portion.

2. Description of the Prior Art

Various furniture corner covers are available in the prior art to afford protection to furniture as well as to individuals. The instant invention is addressed to the protection of an individual's feet, particularly around beds and the like, wherein individuals particularly are without foot protection. Furniture corner cover structure of the prior art is exemplified in the U.S. Pat. Nos. 4,817,902 to Mason; 4,883,332 to Hadad., and U.S. Pat. No. 260,590 to Hobson.

Accordingly, it may be appreciated that there continues to be a need for a new and improved furniture corner cover as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of furniture corner cover structure now present in the prior art, the present invention provides a furniture corner cover wherein the same is arranged for mounting to a bottommost end portion of a furniture leg or corner construction. As such, the general purpose of the present invention, which will be described subsequently in greater detail, is to provide a new and improved furniture corner cover which has all the advantages of the prior art furniture corner covers and none of the disadvantages.

To attain this, the present invention provides a cushioned corner cover member arranged for mounting to a lower distal end of furniture corners to afford protection to individuals inadvertently impacting to the corner portions of such furniture structure. The corner cover members are each formed with a first and second cushioned wall orthogonally oriented relative to one another having a flexible web spanning a bottom wall of each corner wall to accommodate a furniture leg thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved furniture corner cover which has all the advantages of the prior art furniture corner covers and none of the disadvantages.

It is another object of the present invention to provide a new and improved furniture corner cover which may be easily and efficiently manufactured and marketed.

It is a further object of the present invention to provide a new and improved furniture corner cover which is of a durable and reliable construction.

An even further object of the present invention is to provide a new and improved furniture corner cover which is susceptible of a low cost of manufacture with regard to both materials and labor, and which accordingly is then susceptible of low prices of sale to the consuming public, thereby making such furniture corner covers economically available to the buying public.

Still yet another object of the present invention is to provide a new and improved furniture corner cover which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an isometric illustration of section 10 as set forth in FIG. 3a.

DESCRIPTION OF THE PREFERRED EMBODIMENT

Figure 1:
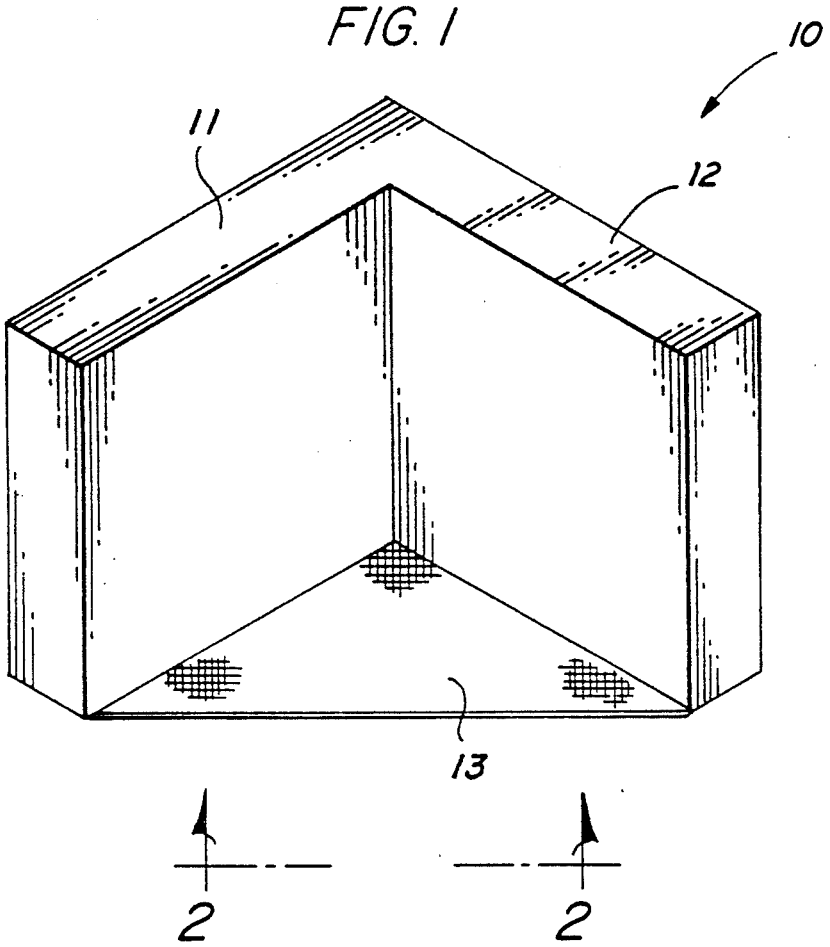
FIG. 1 is an isometric illustration of the instant invention.
Figure 2:
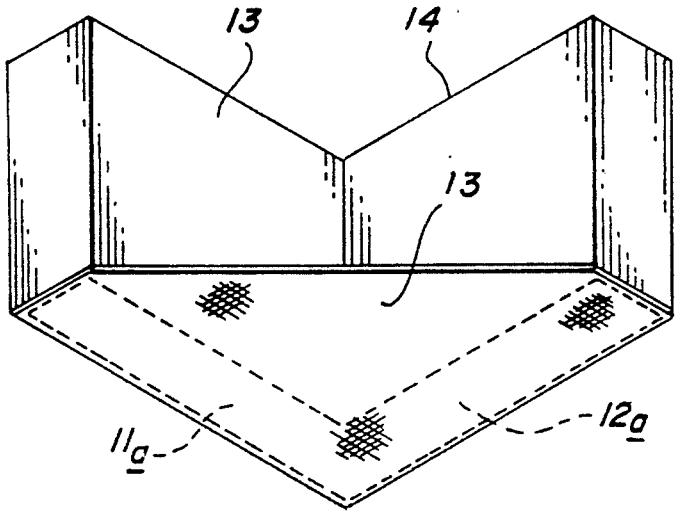
FIG. 2 is an isometric bottom view of the instant invention.

With reference now to the drawings, and in particular to FIGS. 1 to 10 thereof, a new and improved furniture corner cover embodying the principles and concepts of the present invention and generally designated by the reference numeral 10 will be described.

More specifically, the furniture corner cover 10 of the instant invention essentially comprises a first cushioned wall 11 formed of a polymeric foam material orthogonally oriented relative to a second cushioned wall 12 having the first and second cushioned walls 11 and 12 integrally secured relative to one another. The first cushioned wall 11 includes a first cushion wall bottom wall 11a, with the second cushioned wall including a second cushion wall bottom wall 12a that are orthogonally oriented relative to one another in a coplanar relationship. A flexible web 13 of a generally triangular configuration is mounted to the first and second bottom walls 11a and 12a spanning the first and second cushioned walls 11 and 12 to accommodate a furniture lowermost leg portion, such as illustrated in FIG. 3a, therewithin. In this manner, inadvertent injury due to unavoidable impact to a furniture corner leg is avoided.

Figure 3:
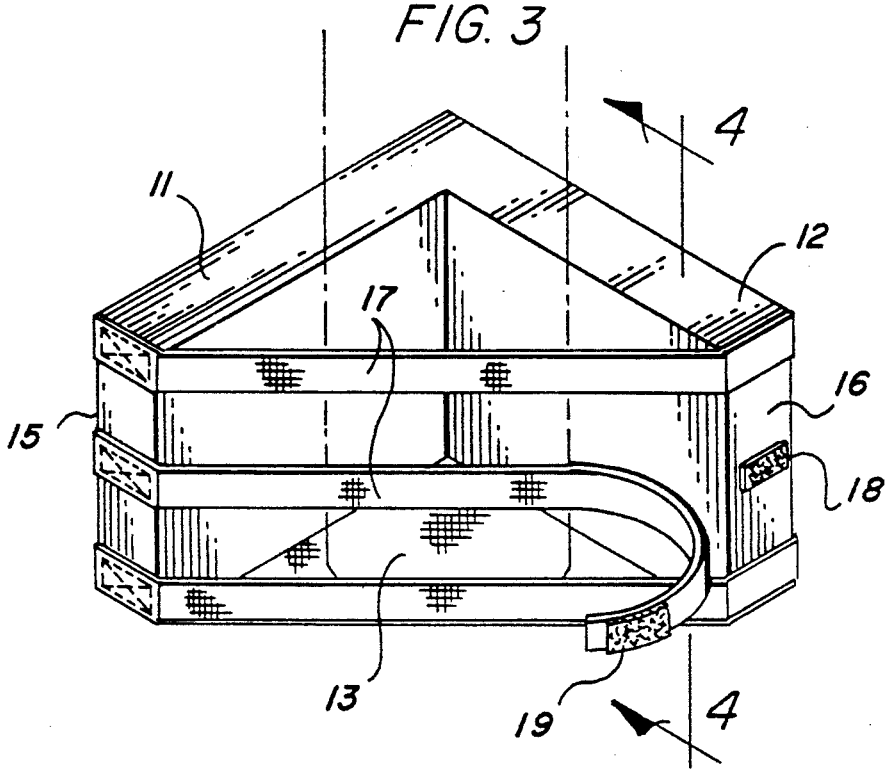
FIG. 3 is an isometric illustration of a modified aspect of the invention.
Figure 3A:
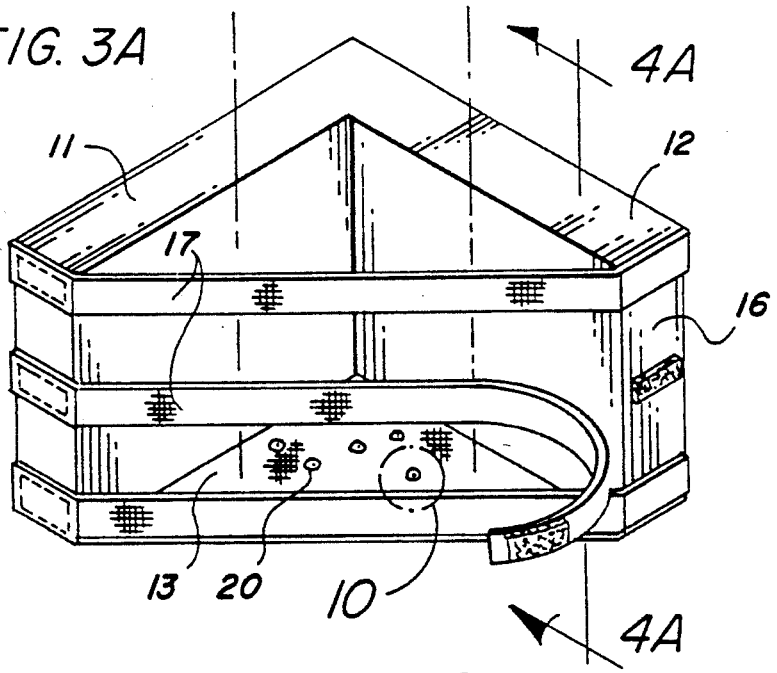
FIG. 3*a* is an isometric illustration of a further modified aspect of the invention.
Figure 10:
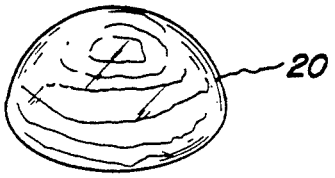

The invention as illustrated in the FIGS. 3 and 3a illustrates the use of flexible strap members 17 extending from a first cushioned wall first end wall 15, with the second cushioned wall 12 including a second wall end wall 16. The second wall end wall 16 includes a plurality of second end wall first hook and loop fastener portions 18 cooperative with second hook and loop fastener portions 19 mounted to the free distal ends of the flexible strap members 17 having their rear end portions secured to the first wall end wall 15 to thereby encompass a furniture leg mounted within the organization, as illustrated in FIG. 3a and the FIG. 3.

Figure 4:
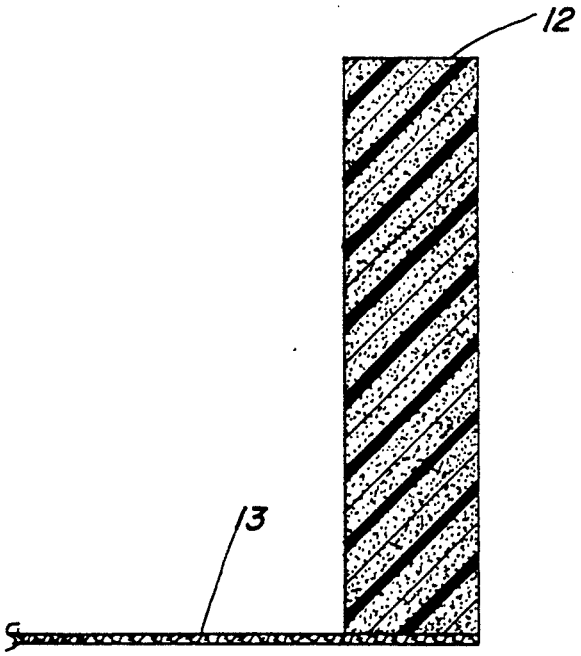
FIG. 4 is an orthographic view, taken along the lines 4—4 of FIG. 3 in the direction indicated by the arrows.
Figure 4A:
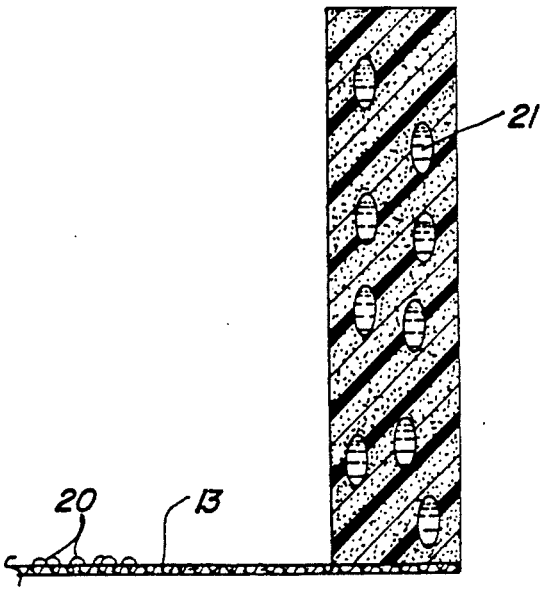
FIG. 4*a* is an orthographic view, taken along the lines 4*a*—4*a* of FIG. 3 in the direction indicated by the arrows.

The FIGS. 4 and 4a further illustrate that a top surface of the flexible web 13 includes a plurality of fluid glue filled first capsules 20 arranged to adherably secure the flexible web 13 to such furniture leg, wherein the first and second cushioned walls 11 and 12 include coextensively throughout their interior a matrix of fluid dye filled second capsules 21. The fluid dye filled capsules, upon bursting, permeate the polymeric foam structure of the first and second cushioned walls to indicate various corners of furniture that are subject to impact to thereby permit individuals to maintain such corner cushion structure requiring more frequent replacement and care due to a more frequent impact of such corner structure to thereby provide for an impact indicator structure in the use of the second capsules 21.

Figure 5:
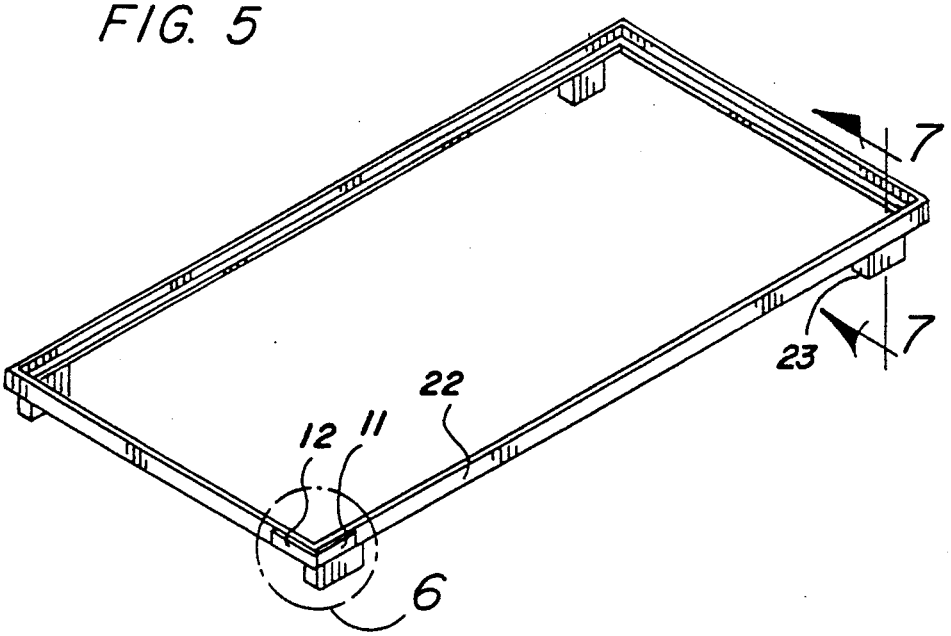
FIG. 5 is an isometric illustration of a conventional bed frame utilized by the invention.
Figure 6:
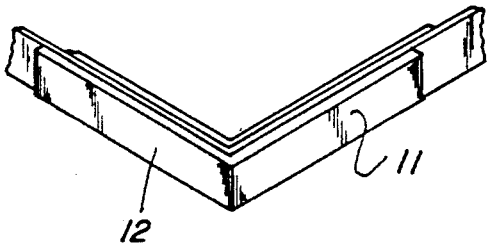
FIG. 6 is an isometric view of section 6 as set forth in FIG. 5.
Figure 7:
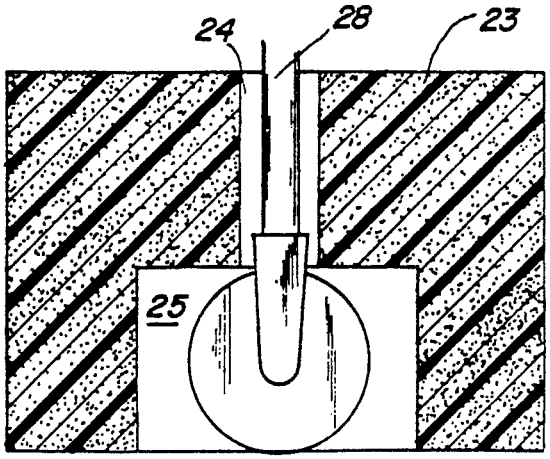
FIG. 7 is an orthographic view, taken along the lines 7—7 of FIG. 5 in the direction indicated by the arrows.
Figure 8:
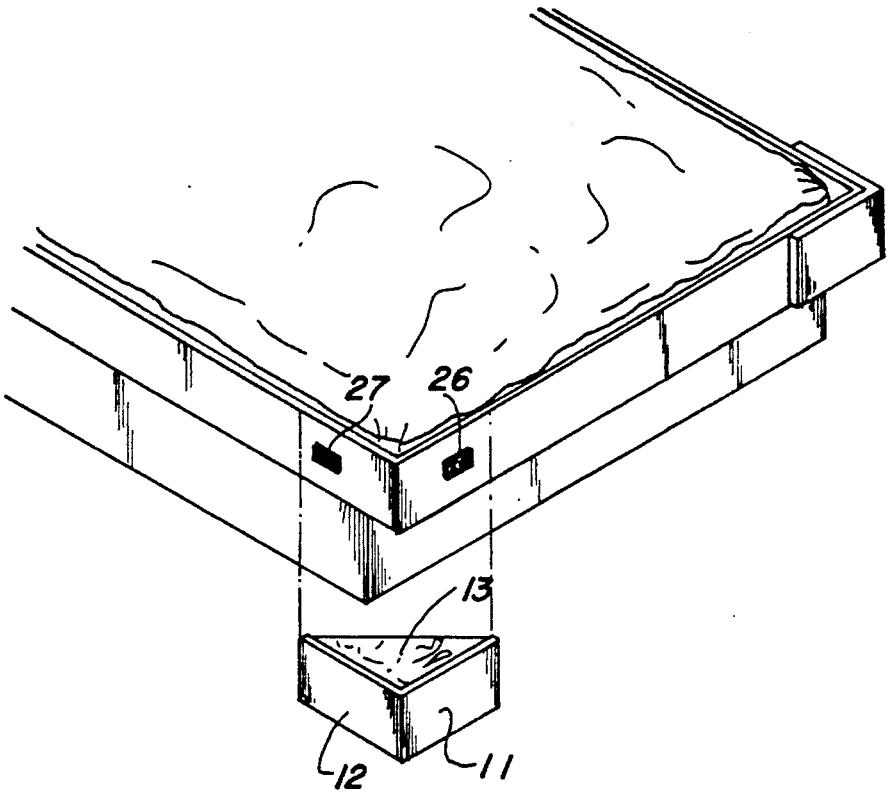
FIG. 8 is an isometric illustration of the invention mounted to a further corner portion of a furniture member.
Figure 9:
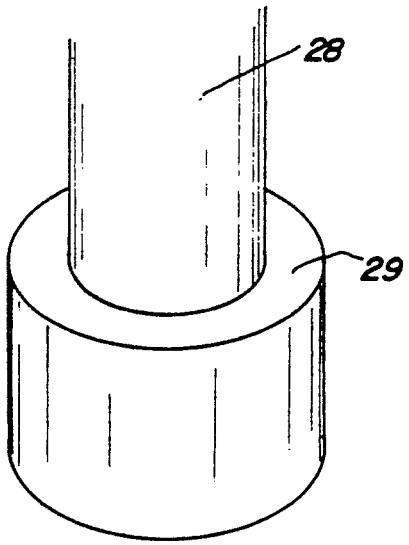
FIG. 9 is an isometric illustration of a leg member of a furniture support.

The FIG. 5 illustrates the use of a bed frame structure 22 having the organization mounted thereto to the corners thereof, with a support block 23 extending downwardly relative to the flexible web 13 having a support block channel 24 receiving a bed frame leg 28 therethrough terminating in a support block cavity 25, with the lower distal end of the bed frame leg 28 utilizing a wheel structure, as illustrated in FIG. 7 or conversely, a support foot 29.

Securement of the structure to various corners may be further effected by further employing third and fourth hook and loop fasteners 26 and 27 cooperating with interior surfaces of the first and second cushioned walls 11 and 12 positioned above the flexible web 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A furniture corner cover, comprising, a first cushioned wall fixedly and orthogonally mounted to a second cushioned wall defining an L-shaped configuration, the first cushioned wall includes a first cushioned wall bottom wall, the second cushioned wall including a second cushioned wall bottom wall, wherein the first cushioned wall bottom wall and the second cushioned wall bottom wall are arranged in a coplanar orthogonal orientation relative to one another, and a triangular flexible web mounted to the first cushioned wall bottom wall and the second cushioned wall bottom wall extending between the first cushioned wall and the second cushioned wall coextensively of the first cushioned wall bottom wall and the second cushioned wall bottom wall, and the first cushioned wall includes a first end wall, the second cushioned wall includes a second end wall, and a plurality of flexible strap members fixedly mounted to the first end wall, with the second end wall including a plurality of second hook and loop fastener members each including a free end portion, each free end portion includes a second hook and loop fastener portion, wherein each second hook and loop fastener portion is arranged for securement to a first hook and loop fastener portion, and the flexible web includes a flexible web top surface positioned between the first cushioned wall and the second cushioned wall, and a plurality of fluid glue filled capsules arranged for mounting to the flexible web top surface for adherence to a furniture leg positioned thereon, and the first cushioned wall and the second cushioned wall each include a matrix of fluid dye filled capsules arranged coextensively within the first cushioned wall and the second cushioned wall for indication of impact relative to the first cushioned wall and the second cushioned wall.

* * * * *